US009198834B2

(12) United States Patent
Solvell

(10) Patent No.: US 9,198,834 B2
(45) Date of Patent: Dec. 1, 2015

(54) MEDICATION DISPENSING STATION

(71) Applicant: Stefan Erik Solvell, Wellesley, MA (US)

(72) Inventor: Stefan Erik Solvell, Wellesley, MA (US)

( * ) Notice: Subject to any disclaimer, the term of this patent is extended or adjusted under 35 U.S.C. 154(b) by 0 days.

(21) Appl. No.: 14/205,473

(22) Filed: Mar. 12, 2014

(65) Prior Publication Data

US 2014/0263458 A1 Sep. 18, 2014

Related U.S. Application Data

(60) Provisional application No. 61/777,453, filed on Mar. 12, 2013.

(51) Int. Cl.
*A61J 1/03* (2006.01)
*A61J 7/00* (2006.01)

(52) U.S. Cl.
CPC ..... *A61J 7/0076* (2013.01); *A61J 7/0046* (2013.01)

(58) Field of Classification Search
CPC ..... A61J 7/00076; A61J 7/03; A61J 7/0046; A47K 5/13
USPC ..... 222/166, 167, 173; 414/419, 421; 248/141, 139; 220/475
See application file for complete search history.

(56) References Cited

U.S. PATENT DOCUMENTS

| | | | | |
|---|---|---|---|---|
| 1,878,348 | A * | 9/1932 | Te Selle | 222/166 |
| 2,467,866 | A * | 4/1949 | Smolderen et al. | 248/136 |
| 3,198,395 | A * | 8/1965 | McKinney | 222/166 |
| 4,187,950 | A * | 2/1980 | Peet | 414/421 |
| 6,575,337 | B1 * | 6/2003 | Malavear | 222/166 |
| 7,108,153 | B2 | 9/2006 | Wood | |
| 8,550,475 | B2 * | 10/2013 | Chauza | 280/47.19 |
| 2008/0169300 | A1 | 7/2008 | Yamamoto | |
| 2013/0030566 | A1 | 1/2013 | Shavelsky | |

* cited by examiner

*Primary Examiner* — Kevin P Shaver
*Assistant Examiner* — Robert Nichols, II

(57) ABSTRACT

A medication dispensing station is provided. The medication dispensing station includes a support base and a cradle pivotally attached to the support base in an elevated position relative to the support base. A medication dispenser may be releasably attachable to the cradle. Therefore, a patient may easily attach the medication dispenser to the cradle, and pivot the cradle to dispense the medication.

9 Claims, 4 Drawing Sheets

MEDICATION DISPENSING STATION

CROSS-REFERENCE TO RELATED APPLICATION

This application claims the benefit of priority of U.S. provisional application No. 61/777,453, filed Mar. 12, 2013, the contents of which are herein incorporated by reference.

BACKGROUND OF THE INVENTION

The present invention relates to a medication dispensing device and, more particularly, to a cradle that secures and rotates a medicine container.

Currently, numerous amounts of elderly patients need to take one or several medications. Many of these patients find it difficult to dispense multiple tablets, and may have manual dexterity issues that make handling small tablets difficult. Therefore the user may spill the medicine or drop the pills on the floor. There are dispensing stations available, however the dispensing stations are difficult to use and make it difficult for the user to attach the pill box or dispenser to the dispensing device. The effort required to dispense medications is significant and may be impossible for somebody with limited manual dexterity.

As can be seen, there is a need for a device that helps dispense oral solid and liquid medicines.

SUMMARY OF THE INVENTION

In one aspect of the present invention, a dispensing station comprises: a support base; a cradle pivotally attached to the support base in an elevated position above the support base; a medication dispenser; and a connector releasably attaching the medication dispenser to the cradle.

In another aspect of the present invention, a dispensing station comprises: a support base; a cradle pivotally attached to the support base in an elevated position above the support base; a medication dispenser; and a connector comprising a male portion and a female portion releasably attachable to one another, wherein the medication dispenser comprises the male portion and the cradle comprises the female portion.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a medication dispensing station. The medication dispensing station includes a support base and a cradle pivotally attached to the support base in an elevated position relative to the support base. A medication dispenser may be releasably attachable to the cradle. Therefore, a patient may easily attach the medication dispenser to the cradle, and pivot the cradle to dispense the medication.

The present invention may include a dispensing station for oral solid medications stored in a pill box or locked pill dispenser or for syrups and liquids with or without being contained in a bottle. The present invention may allow a patient to easily secure the pill box or locked medicine dispenser to a pivoting surface or cradle with a handle. Once the pill box or dispenser is attached to the pivoting surface or cradle, the patient may simply move the handle forward or pivot the surface and the medicine pours or falls out of the pill box or dispenser and may be collected in a cup. The present invention allows a user to simply insert the pill box or dispenser onto the cradle and rotate the pill box or dispenser approximately 45 degrees to secure.

Figure 1:
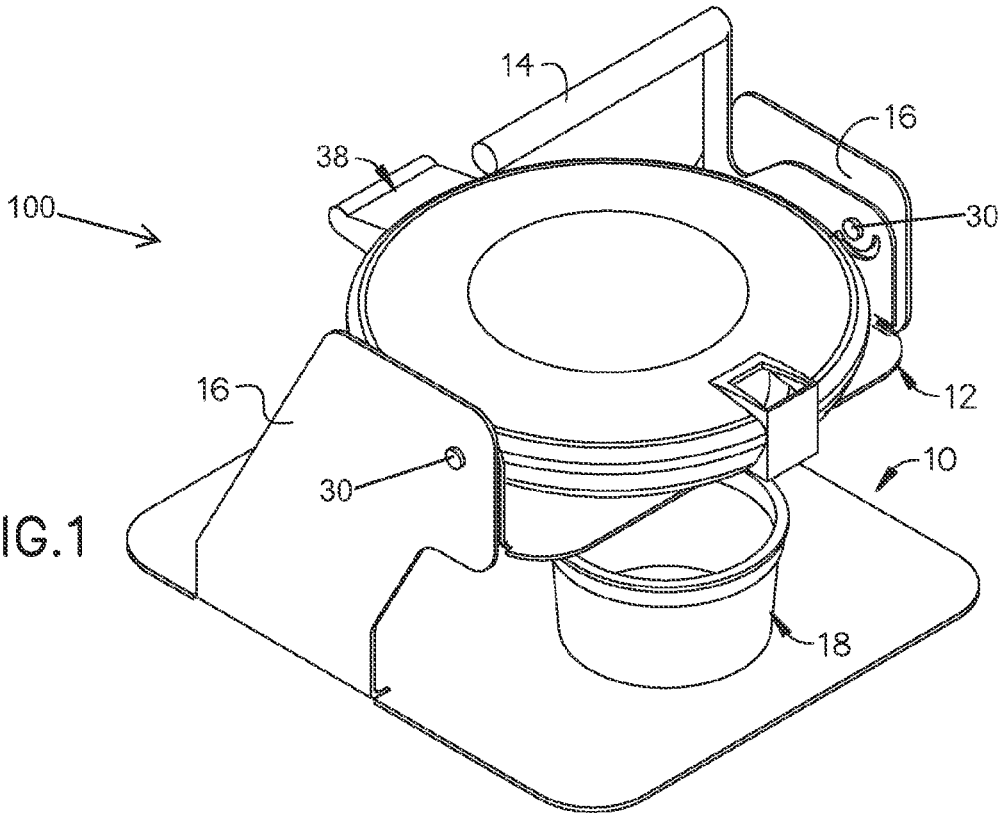
FIG. 1 is a perspective view of the present invention.
Figure 2:
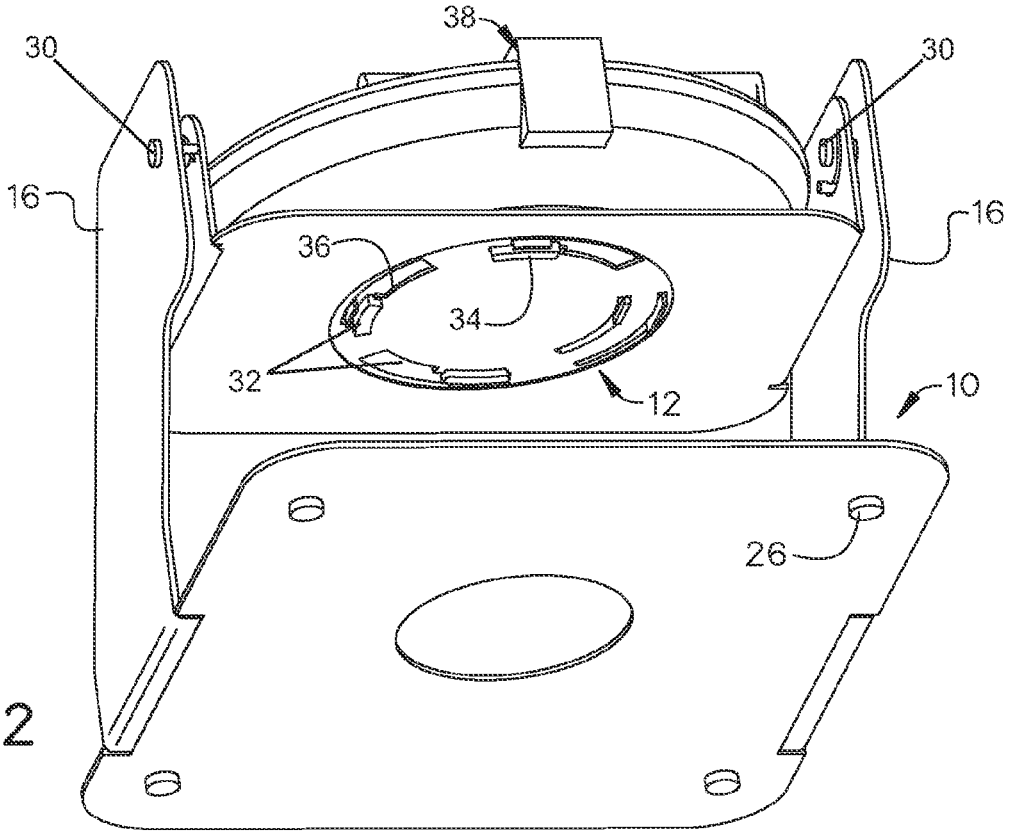
FIG. 2 is a lower perspective view of the present invention.
Figure 3:
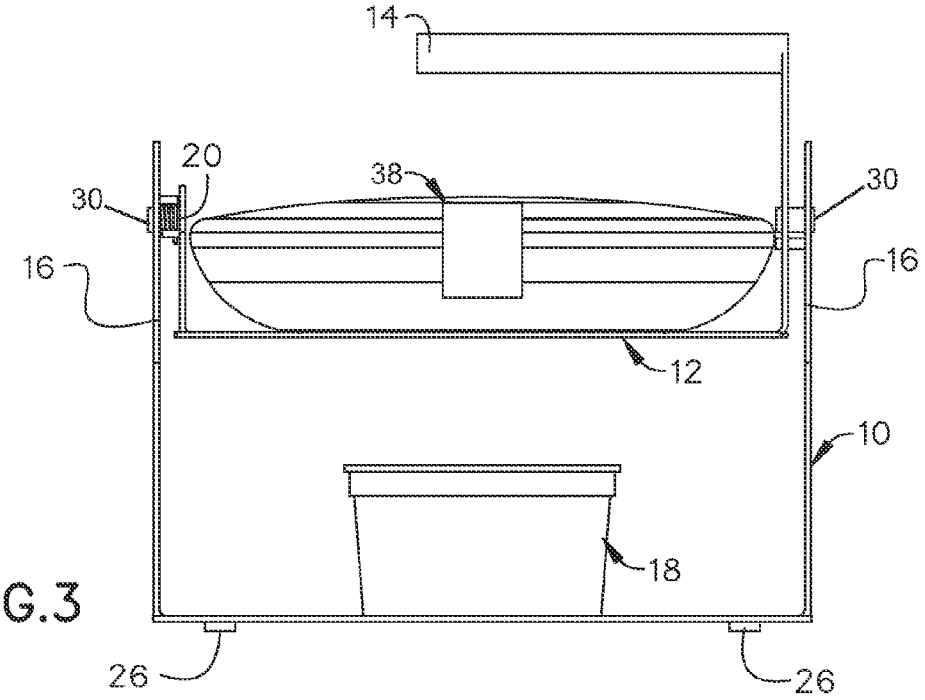
FIG. 3 is a front view of the present invention.
Figure 4:
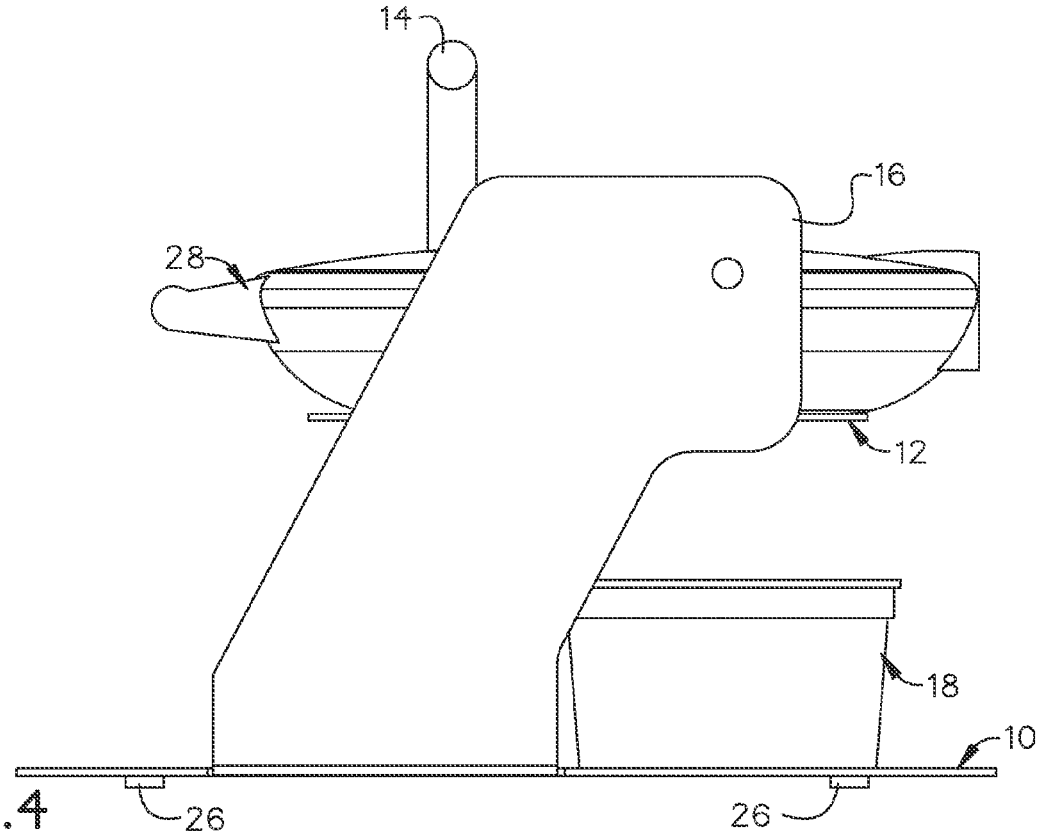
FIG. 4 is a side view of the present invention.
Figure 5:
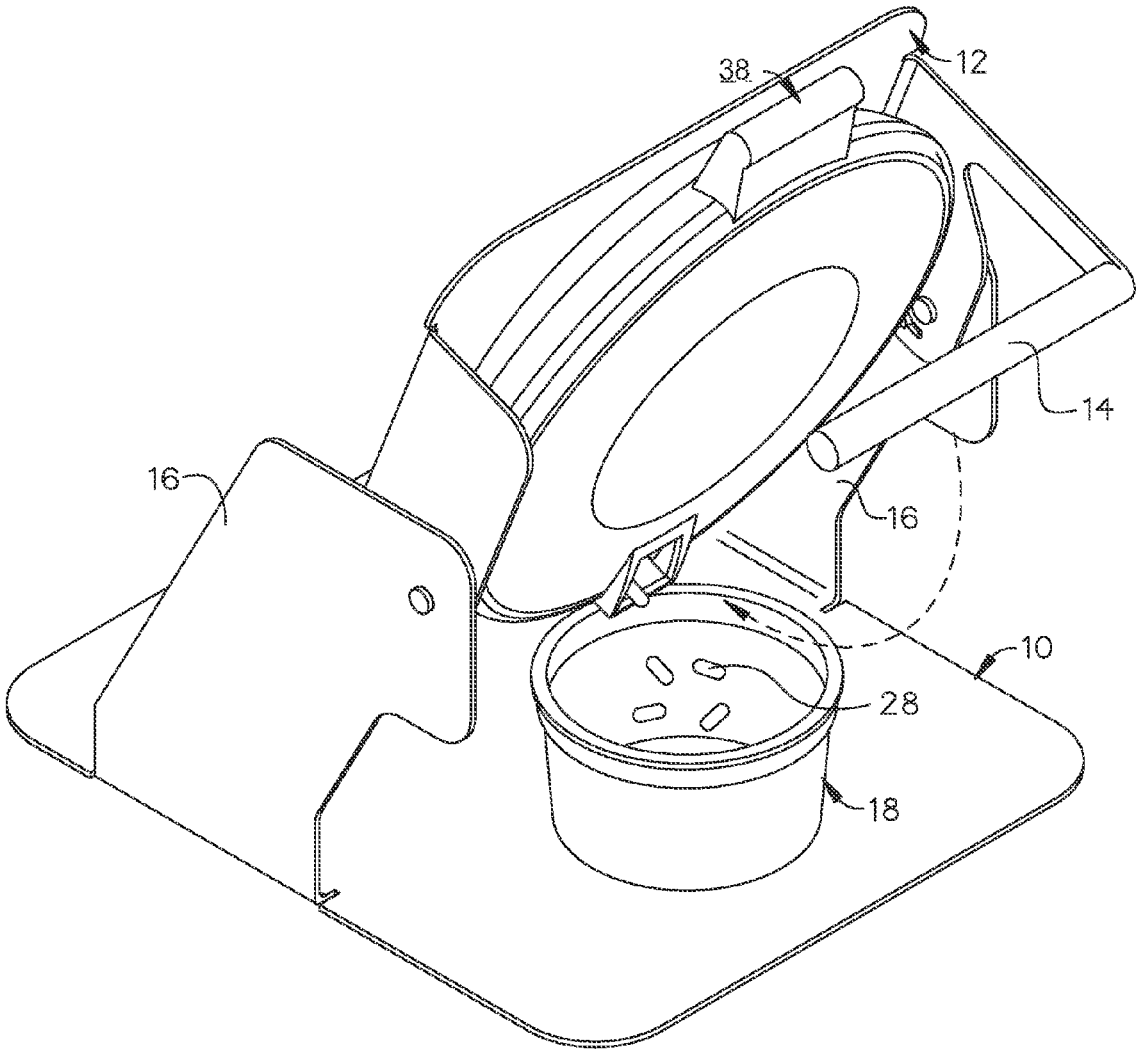
FIG. 5 is a perspective view of the present invention shown dispensing oral solid medications.
Figure 6:
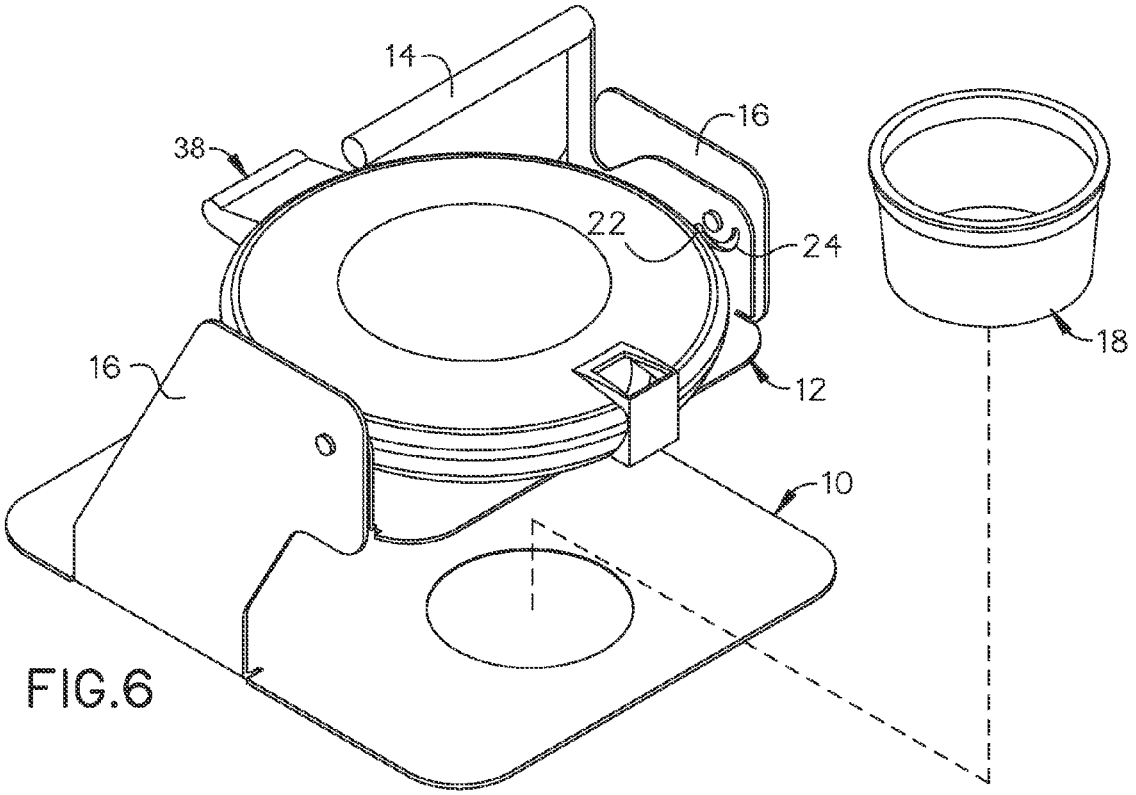
FIG. 6 is an exploded view of the present invention demonstrating removal of the cup of FIG. 1.
Figure 7:
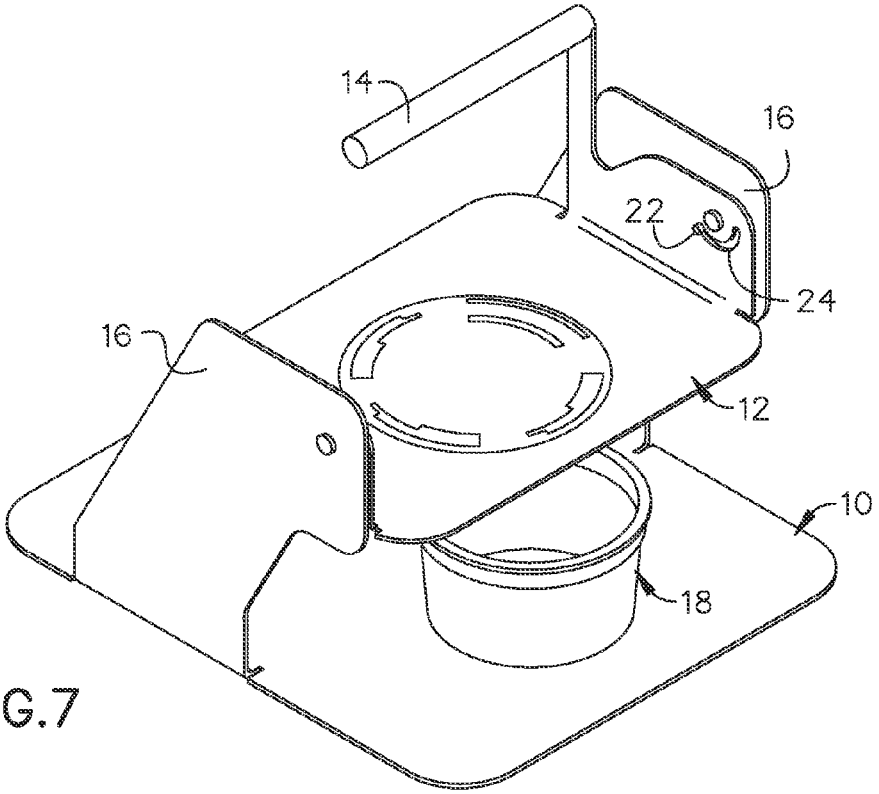
FIG. 7 is a perspective view of the present invention shown without the medication dispenser of FIG. 1.

Referring to FIGS. 1 through 7, the present invention includes a dispensing station 100. The dispensing station 100 includes a support base 10 and a cradle 12 pivotally attached to the support base 10 in an elevated position above the support base 10. The support base 10 may include feet 26 protruding from the bottom surface of the support base 10 to add additional grip to the surface on which the support base 10 is placed. The present invention may further include a medication dispenser 38 containing medication 28. The medication dispenser 38 may be releasably attachable to the cradle 12 by a connector 32. The connector 32 includes a male portion and a female portion. The cradle 12 includes at least one of the male portion and the female portion and the medication dispenser 38 includes at least one of the male portion and the female portion that mates with the at least one of the male portion and the female portion of the cradle 12.

In certain embodiments, the medication dispenser 38 may include the male portion and the cradle may include the female portion. The male portion may be a ridge 34 protruding from the bottom of the medication dispenser 38, and the female portion may be a slot 36 formed through the cradle 12. In certain embodiments, the ridge 34 may include a lip having a width larger than a width of the ridge 34. The slot 36 of the present invention may include an unlocked section and a locked section. The unlocked section may include a width to receive the lip and the locked section may include width smaller than the lip. Therefore, a user may insert the ridge 34 with the lip into the unlocked section of the slot 36 and rotate the medication dispenser 38 so that the ridge 34 is within the locked section of the slot 36. Since the lip has a larger width than the locked section of the slot 36, the ridge 34 is secured to the cradle 12.

In certain embodiments, the present invention may include a first base pivot arm 16 and a second base pivot arm 16 attached to the support base 10. The first base pivot arm 16 and the second base pivot arm 16 may be substantially perpendicular to the support base 10. The cradle 12 may be pivotally attached to the first base pivot arm 16 by a first hinge 30 and the second base pivot arm 16 by a second hinge 30. In certain embodiments, the present invention may include a spring 20 attached to at least one of the first hinge 30 and the second hinge 30. The spring 20 may bias the cradle 12 to be substantially parallel with the support base 10. Therefore, when a user rotates the cradle 12, the cradle 12 may be released and bias back to a horizontal position relative to the support base 10.

In certain embodiments, at least one of the cradle 12, the first base pivot arm 16 and the second base pivot arm 16 includes at least one channel 24. Further, at least one of the cradle 12, the first base pivot arm 16, and the second base pivot arm 16 may include a peg 22 protruding into the channel 24, and thereby limiting the rotation of the cradle 12 relative to the support base 10. In certain embodiments, the channel 24 may be formed through the cradle 12 and either the first base pivot arm 16 or the second base pivot arm 16 may include the peg 22 that extends into the channel 24.

The cradle 12 may be pivoted to dispense the medication 28. In certain embodiments, the cradle 12 may include a handle 14 to easily pivot the cradle 12 relative to the support base 10. In certain embodiments, the present invention may include a motor in which the cradle 12 may be pivoted automatically. For example, the cradle 12 may be pivoted by using a remote radio signal, such as Bluetooth® or internet (tele health). The dispensing station 100 may be connected to a remote signal or computer facilitating the dispense of medications on a pre-set schedule. The dispensing station 100 may also automatically advance to the next dosage, which triggers the movement of the cradle 12. The cradle 12 movement (to dispense) may also be time delayed. The cradle 12 movement may also be limited to the presence of a certain individual (by means of a RFID tag, optical face recognition or other biometric verification such as a finger print). Once the cradle 12 is tilted about 90 degrees, medications may drop from the open medication dispenser 38 and into the cup 18. The base support 10 may further include a cup holder to place the cup 18 in a correct position below the medication dispenser 38. As an alternative, the medication may be dispensed into the patient's open hand.

A method of using the present invention may include the following. The present invention may allow the patient to easily attach the pill box or locked medicine dispenser to the dispensing station's cradle. Once the pill box or medicine dispenser is attached a patient may remove the pre-loaded medications from the container by using gravitational force to pour the medication into the dispensing cup. The patient may simply move the handle forward to dispense the pre-loaded medication(s) into the cup. Once the medication(s) have landed in the cup the patient releases the handle and the handle returns to its normal horizontal position. The patient may then simply remove the cup (now containing all the medications for this event) and takes her/his medications from the cup.

It should be understood, of course, that the foregoing relates to exemplary embodiments of the invention and that modifications may be made without departing from the spirit and scope of the invention as set forth in the following claims.

What is claimed is:

1. A dispensing station comprising:

a support base;

a cradle pivotally attached to the support base in an elevated position above the support base, wherein a slot is formed through the cradle, the slot comprising an unlocked section and a locked section; and a medication dispenser comprising a ridge protruding from a bottom, wherein the ridge comprises a lip comprising a width larger than a width of the ridge, wherein the unlocked section comprises a width to receive the lip and the locked section comprises a width smaller than the lip, thereby securing the ridge within the locked section when the ridge is rotated into the locked section.

2. The dispensing station of claim 1, further comprising a first base pivot arm and a second base pivot arm, wherein the first base pivot arm and the second base pivot arm are substantially perpendicular to the support base, and wherein the cradle is pivotally attached to the first base pivot arm by a first hinge and the second base pivot arm by a second hinge.

3. The dispensing station of claim 2, wherein at least one of the cradle, the first base pivot arm and the second base pivot arm comprises at least one channel, and wherein at least one of the cradle, the first base pivot arm and the second base pivot arm comprise a peg protruding into the channel, and thereby limiting the rotation of the cradle relative to the support base.

4. The dispensing station of claim 2, further comprising a spring attached to at least one of the first hinge and the second hinge, wherein the spring biases the cradle to be substantially parallel with the support base.

5. The dispensing station of claim 1, further comprising a motor automatically pivoting the cradle when activated.

6. The dispensing station of claim 1, further comprising a handle protruding from the cradle.

7. The dispensing station of claim 1, further comprising a cup holder formed in the support base.

8. A dispensing station comprising:

a support base;

a cradle pivotally attached in an elevated position above the support base;

a first base pivot arm and a second base pivot arm, wherein the first base pivot arm and the second base pivot arm are substantially perpendicular to the support base, and wherein the cradle is pivotally attached to the first base pivot arm by a first hinge and the second base pivot arm by a second hinge;

a medication dispenser; and a connector releasably attaching the medication dispenser to the cradle, wherein at least one of the cradle, the first base pivot arm and the second base pivot arm comprises at least one channel, and wherein at least one of the cradle, the first base pivot arm and the second base pivot arm comprise a peg protruding into the at least one channel, and thereby limiting the rotation of the cradle relative to the support base.

9. A dispensing station comprising:

a support base;

a cradle pivotally attached in an elevated position above the support base;

a first base pivot arm and a second base pivot arm, wherein the first base pivot arm and the second base pivot arm are substantially perpendicular to the support base, and wherein the cradle is pivotally attached to the first base pivot arm by a first hinge and the second base pivot arm by a second hinge;

a medication dispenser;

a connector releasably attaching the medication dispenser to the cradle; and a spring attached to at least one of the first hinge and the second hinge, wherein the spring biases the cradle to be substantially parallel with the support base.

* * * * *